US008110092B2

(12) United States Patent
Petri

(10) Patent No.: US 8,110,092 B2
(45) **Date of Patent: *Feb. 7, 2012**

(54) PROCESS FOR RECOVERING POWER FROM FCC PRODUCT

(75) Inventor: John A. Petri, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/860,959

(22) Filed: Aug. 23, 2010

(65) Prior Publication Data

US 2010/0313562 A1 Dec. 16, 2010

Related U.S. Application Data

(63) Continuation of application No. 11/771,136, filed on Jun. 29, 2007, now Pat. No. 7,799,209.

(51) Int. Cl.
*C10G 11/20* (2006.01)

(52) U.S. Cl. ..... 208/113; 208/114; 208/115; 208/116; 208/117; 208/118; 208/119; 208/121; 208/122; 208/123; 208/124

(58) Field of Classification Search ..... 208/113–124
See application file for complete search history.

(56) References Cited

U.S. PATENT DOCUMENTS 5,073,249 A * 12/1991 Owen ..... 208/48 Q
5,185,077 A * 2/1993 Owen ..... 208/61
2005/0032919 A1* 2/2005 Huisman et al. ..... 518/702

* cited by examiner

*Primary Examiner* — Robert J Hill, Jr.
*Assistant Examiner* — Brian McCaig
(74) *Attorney, Agent, or Firm* — James C Paschall

(57) ABSTRACT

Disclosed is a process for recovery power from an FCC product. Gaseous hydrocarbon product from an FCC reactor is heat exchanged with a heat exchange media which is delivered to an expander to generate power. Cycle oil from product fractionation may be added to the gaseous FCC product to wash away coke precursors.

9 Claims, 1 Drawing Sheet

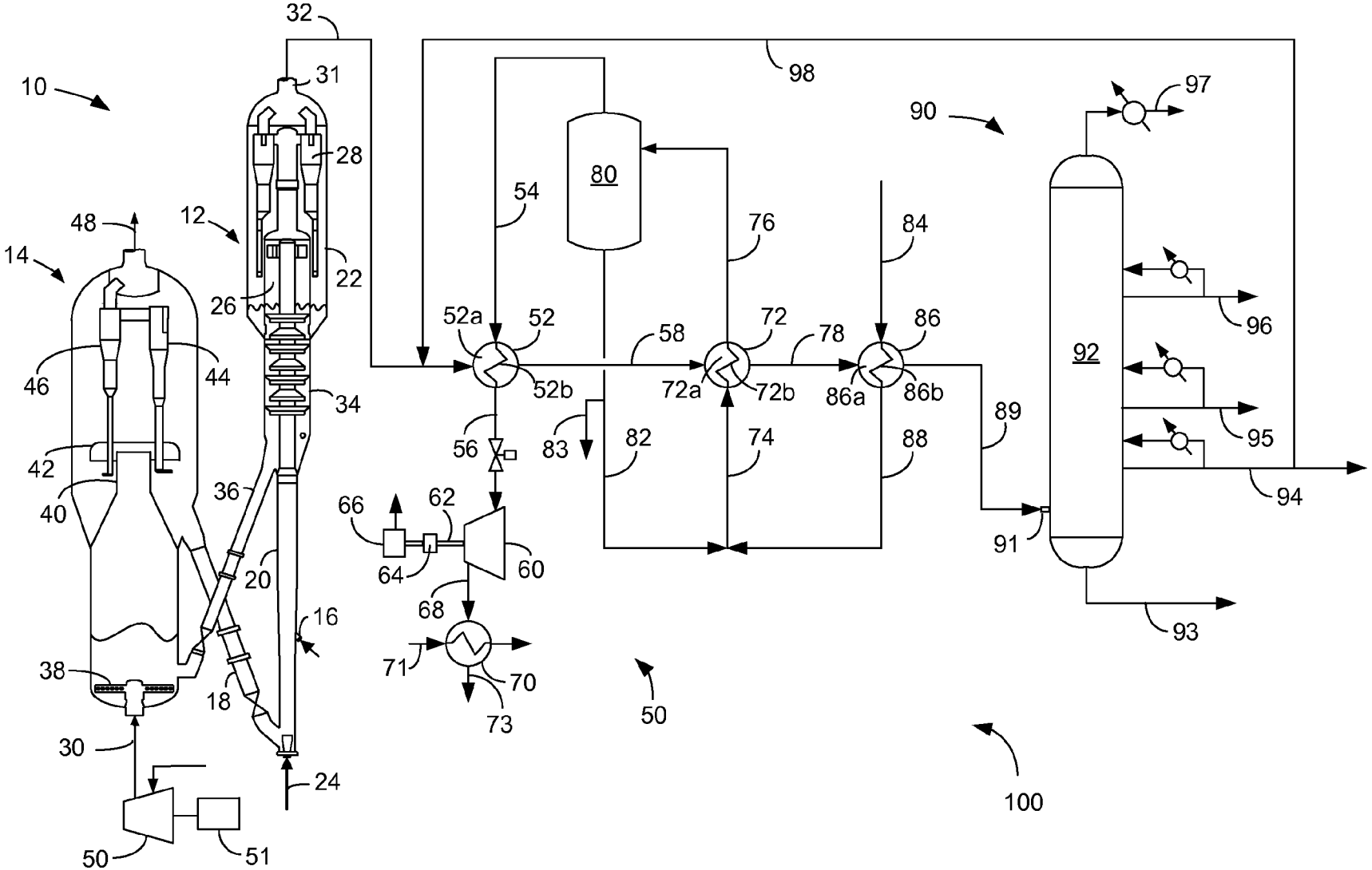
10
12
14
16
18
20
22
24
26
28
30
31
32
34
36
38
40
42
44
46
48
50
51
52
52a
52b
54
56
58
60
62
64
66
68
70
71
72
72a
72b
73
74
76
78
80
82
83
84
86
86a
86b
88
89
90
91
92
93
94
95
96
97
98
100

PROCESS FOR RECOVERING POWER FROM FCC PRODUCT

CROSS-REFERENCE TO RELATED APPLICATION

This application is a Continuation of application Ser. No. 11/771,136 filed Jun. 29, 2007, now U.S. Pat. No. 7,799,209, the contents of which are hereby incorporated by reference in its entirety.

BACKGROUND OF THE INVENTION

The field of the invention is power recovery from a fluid catalytic cracking (FCC) unit. FCC technology, now more than 50 years old, has undergone continuous improvement and remains the predominant source of gasoline production in many refineries. This gasoline, as well as lighter products, is formed as the result of cracking heavier (i.e. higher molecular weight), less valuable hydrocarbon feed stocks such as gas oil.

In its most general form, the FCC process comprises a reactor that is closely coupled with a regenerator, followed by downstream hydrocarbon product separation. Hydrocarbon feed contacts catalyst in the reactor to crack the hydrocarbons down to smaller molecular weight products. During this process, the catalyst tends to accumulate coke thereon, which is burned off in the regenerator. The heat of combustion in the regenerator typically produces flue gas at elevated temperatures of 677° to 788° C. (1250° to 1450° F.) which is an appealing focus of power recovery.

FCC gaseous products exiting the reactor section typically have a temperature ranging between 482° and 649° C. (900° to 1200° F.). The product stream could be an attractive source power recovery but is instead introduced directly into a main fractionation column meaning that no unit operations are interposed on the line between the FCC product outlet and the inlet to the main column. Product cuts from the main column are heat exchanged in a cooler with other streams and pumped back typically into the main column at a tray higher than the pumparound supply tray to cool the contents of the main column. Medium and high pressure steam is typically generated by the heat exchange from the main column pumparounds. Low pressure steam is typically generated at 241 to 448 kPa (gauge) (35 to 65 psig). Medium pressure steam is typically generated at 1035 kPa (gauge) (150 psig) and high pressure steam is typically generated at approximately 4137 kPa (gauge) (600 psig). For example, a stream from the main column bottom may be circulated through heat exchangers to impart process heating or steam generation. The cooled main column bottoms stream is typically returned above the main column flash feed zone to quench the vapors entering the main column from the FCC reactor. The FCC reactor vapors are cooled from 482° to 649° C. (900° to 1200° F.) to temperatures of approximately 371° C. (700° F.) in the main column flash zone. In this way, the FCC reactor effluent vapors are quenched.

However, steam at greater than these pressures can be used to generate incremental power recovery. Very high pressure (VHP) steam is typically generated at 6200 to 11030 kPa (gauge) (900 to 1600 psig). The FCC reactor effluent vapors are at sufficient temperature to generate steam at the pressure levels required to generate this VHP steam.

SUMMARY OF THE INVENTION

We have discovered a process for recovering power from FCC product gas directly upon exiting the FCC reactor section. The FCC product gas is heat exchanged with a heat exchange media such as water to produce steam. The steam is then routed to a generator to recover power. Additionally, it may be preferable to circulate cycle oil from an FCC product recovery section to enter the heat exchanger with the FCC product gases. Any coke precursors accumulating on the heat exchanger equipment would be washed away by the cycle oil. Advantageously, the process can enable the FCC unit to be more energy efficient.

Additional features and advantages of the invention will be apparent from the description of the invention, FIGURE and claims provided herein.

BRIEF DESCRIPTION OF THE DRAWING

The FIGURE is a schematic drawing of an FCC unit, a power recovery section and an FCC product recovery section.

DETAILED DESCRIPTION

Now turning to the FIGURE, wherein like numerals designate like components, the FIGURE illustrates an FCC system 100 that generally includes an FCC unit section 10, a power recovery section 60 and a product recovery section 90. The FCC unit section 10 includes a reactor 12 and a catalyst regenerator 14. Process variables typically include a cracking reaction temperature of 400° to 600° C. (752° to 1112° F.) and a catalyst regeneration temperature of 500° to 900° C. (932° to 1652° F.). Both the cracking and regeneration typically occur at an absolute pressure below 507 kPa (74 psia). The FIGURE shows a typical FCC process unit of the prior art, where a heavy hydrocarbon feed or raw oil stream in a line 16 is contacted with a newly regenerated cracking catalyst entering from a regenerated catalyst standpipe 18. This contacting may occur in a narrow riser 20, extending upwardly to the bottom of a reactor vessel 22. The contacting of feed and catalyst is fluidized by gas from a fluidizing line 24. Heat from the catalyst vaporizes the oil, and the oil is thereafter cracked to lighter molecular weight hydrocarbons in the presence of the catalyst as both are transferred up the riser 20 into the reactor vessel 22. The cracked light hydrocarbon products are thereafter separated from the cracking catalyst using cyclonic separators which may include a rough cut separator 26 and one or two stages cyclones 28 in the reactor vessel 22. Product gases exit the reactor vessel 10 through an outlet 31 to line 32 to subsequent product recovery section 90. Inevitable side reactions occur in the riser 20 leaving coke deposits on the catalyst that lower catalyst activity. The spent or coked catalyst requires regeneration for further use. Coked catalyst, after separation from the gaseous product hydrocarbon, falls into a stripping section 34 where steam is injected through a nozzle to purge any residual hydrocarbon vapor. After the stripping operation, the coked catalyst is fed to the catalyst regeneration vessel 14 through a spent catalyst standpipe 36.

The FIGURE depicts a regenerator vessel 14 known as a combustor. However, other types of regenerator vessels are suitable. In the catalyst regenerator vessel 14, a stream of oxygen-containing gas, such as air, in line 30 is introduced through an air distributor 38 to contact the coked catalyst, burn coke deposited thereon, and provide regenerated catalyst and flue gas. A main air blower 50 is driven by a driver 51 to deliver oxygen into the regenerator 14. The driver 52 may be, for example, a motor, a steam turbine driver, or some other device for power input. The catalyst regeneration process adds a substantial amount of heat to the catalyst, providing energy to offset the endothermic cracking reactions occurring in the reactor conduit 16. Catalyst and air flow upward together along a combustor riser 40 located within the catalyst regenerator vessel 14 and, after regeneration, are initially separated by discharge through a disengager 42. Finer separation of the regenerated catalyst and flue gas exiting the disengager 42 is achieved using first and second stage separator cyclones 44, 46, respectively within the catalyst regenerator vessel 14. Catalyst separated from flue gas dispenses through diplegs from cyclones 44, 46 while flue gas relatively lighter in catalyst sequentially exits cyclones 44, 46 and exits the regenerator vessel 14 through line 48. Regenerated catalyst is recycled back to the reactor riser 12 through the regenerated catalyst standpipe 18. As a result of the coke burning, the catalyst transferred to the reactor riser 20 is very hot supplying the heat of reaction to the cracking reaction.

The product gas leaving the FCC reactor section 12 in line 32 through outlet 31 is very hot, at over 482° C. (900° F.), and carrying much energy. The present invention proposes a power recovery section 50 to recover power from the hot product gas. A first heat exchanger 52 is in downstream communication with the outlet 31 of the reactor 12. Line 32 delivers the product gas stream to a hydrocarbon side 52*a* of a first heat exchanger 52 to indirectly heat exchange the gaseous product hydrocarbon stream with a preferably vaporous heat exchange media delivered in line 54 to a heat exchange media side 52*b*. The indirect heat exchange provides superheated heat exchange media in line 56 and provides a hot product hydrocarbon stream in line 58. The stream in line 58 is cooler than the stream in line 32; whereas, the stream in line 56 is hotter than the stream in line 54. The heat exchange media is preferably steam but other media may be suitable. Steam in line 56 is superheated above its saturated vapor temperature based on the delivery pressure from vessel 80. An expander 60 is in downstream communication with the heat exchange media side 52*b*. The superheated heat exchange media is directed through a control valve to the expander 60 in which it turns a shaft 62 coupled through an optional gear box 64 to electrical generator 66 to generate electrical power. A condenser 70 is in downstream communication with the expander 60. The heat exchange media exhausted from the expander in line 68 may be further condensed in the condenser 70 thereby further reducing the volume of the heat exchange media. In this way, the heat exchange media exhausted from the expander is exhausted to near vacuum pressure to increase the power production in generator 66. The condenser 70 is preferably a heat exchanger which indirectly exchanges heat with a second heat exchange media provided by line 71. Condensed heat exchange media exits condenser 70 in line 73. The product gas stream in line 32 preferably encounters first heat exchanger 52 directly, without encountering any unit operation before entering the first heat exchanger 52. At least one heat exchanger 52, 72 or 86 is on a line communicating the reactor with the main fractionation column The hot product hydrocarbon stream in line 58 can still be used to heat up heat exchange media. Line 58 delivers a hot product hydrocarbon stream to a hydrocarbon side 72*a* of a second heat exchanger 72 which indirectly heat exchanges the hot product hydrocarbon stream in line 58 against preheated heat exchange media from line 74 in a heat exchange media side 72*b*. The hydrocarbon side 72*a* is in downstream communication with the hydrocarbon side 52*a* of the first heat exchanger 52. Intermediately heated heat exchange media exits from the second heat exchanger 72 in line 76. A warm product hydrocarbon stream leaves second heat exchanger 72 in line 78. The stream in line 78 is cooler than the stream in line 58; whereas, the stream in line 76 is hotter than the stream in line 74. A heat exchange media drum 80 is in downstream communication with the heat exchange media side 72*b*. Line 76 delivers intermediately heated heat exchange media to heat exchange media drum 80. A vaporous overhead stream from heat exchange media drum 80 provides vaporous heat exchange media in line 54, which is preferably steam. The heat exchange media side 72*b* of the second heat exchanger is in downstream communication with a liquid blowdown outlet line 82 from the heat exchange media drum 80 via lines 82 and 74. The liquid blowdown stream in line 82 provides a portion of preheated heat exchange media in line 74 and a purge in line 83. A third heat exchanger 86 has a hydrocarbon side 86*a* and a heat exchange media side 86*b*. The hydrocarbon side 86*a* is in downstream communication with the hydrocarbon side 72*a* of the second heat exchanger 72. The warm product hydrocarbon stream in line 78 is further heat exchanged in the hydrocarbon side 86a against fresh heat exchange media from line 84 in the heat exchange media side 86*b* of the third heat exchanger 86. The heat exchange media side 72*b* of the second heat exchanger 72 is in downstream communication with the heat exchange media side 86*b* of the third heat exchanger 86. Preheated heat exchange media leaves heat exchanger 86 in line 88 to provide the other portion of preheated heat exchange media in line 74. A lower heat hydrocarbon stream leaves the third heat exchanger in line 89. The main fractionation column 92 is in downstream communication with the hydrocarbon side 86*a*. The stream in line 89 is cooler than the stream in line 78; whereas, the stream in line 88 is hotter than the stream in line 84. The pressure drop in the product streams 32, 58, 78 and 89 is minimal so as to avoid elevated pressures in the FCC reactor. These product streams may be processed at about 69 to 483 kPa (10 to 70 psia) and preferably at about 206 to 345 kPa (30 to 50 psia). The pressure of the heating media should be high enough to create high power generation efficiency in expander 60. The pressure of the heating media streams in lines 84, 88, 74, 82, 76, 54 and 56 may be about 6177 to about 12659 kPa (896 to about 1836 psia) if the heating media is steam. The first heat exchanger should bring the temperature of the heating media in line 56 above its saturation temperature, which is approximately 279° to 329° C. (535° to 625° F.) for steam at 6180 to 12665 kPa (896 to 1836 psia). The steam temperature in line 56 may be superheated to between about 371° and 482° C. (700° to 900° F.). The first, second and third heat exchangers 52, 72 and 86, respectively, may be a shell and tube heat exchangers with the hydrocarbon on the shell side and the heat exchange media on the tube side, but other heat exchangers and arrangements may be suitable.

In the product recovery section 90, at least a portion of lower heat FCC product stream in line 89, which is at least a portion of the gaseous product stream from the FCC reactor in line 32, the hot product stream in line 58, or the warm product stream in line 78 is directed to a lower section of an FCC main fractionation column 92 through inlet 91. Inlet 91 is in downstream communication with the first, second and third heat exchangers 52, 72, 86, respectively, and the product outlet 31 of the FCC reactor 12. Several fractions may be separated and taken from the main column including a heavy slurry oil from the bottoms in line 93, a heavy cycle oil stream in line 94, a light cycle oil in line 95 and a heavy naphtha stream in line 96. Any or all of lines 93-96 may be cooled and pumped back to the main column 92 to cool the main column typically at a tray location higher than the stream draw tray. However, because sufficient heat is removed from the FCC product stream, the bottoms pump around may be unnecessary. However, it is contemplated that slurry oil in bottoms line 93 may be used to heat the fresh heat exchange media in line 84. Gasoline and gaseous light hydrocarbons are removed in overhead line 97 from the main column 92 and condensed before further processing.

Very heavy oil droplets may not be completely vaporized in the FCC reactor vapors and could form coke in the first, second and third heat exchangers 52, 72 and 86, respectively. Therefore, a cyclic oil such as LCO from line 95 or HCO from line 94 from the main column 92 may be circulated with the gaseous hydrocarbons from line 32 to keep the tubes of the first heat exchanger 52 or subsequent downstream second and third heat exchangers 72 and/or 86, respectively, wetted on the tube walls. In the FIGURE, first, second and third heat exchangers 52, 72 and 86, respectively, are in downstream communication with a product line 94. For example, a portion of the HCO stream in line 94 is recycled in line 98 and joins line 32 carrying the gaseous hydrocarbon products before entering the first heat exchanger 52. Alternatively, both lines 32 and 98 could enter the heat exchanger separately. It is also contemplated that in a shell and tube heat exchanger, the hydrocarbon product would be on the shell side, and the heat exchange media be on the tube side, but vice-versa may be acceptable. Suitably, about 5 to 25 wt-% and preferably, about 10 to 15 wt-% of the hydrocarbon fed to the first heat exchanger 52 should be recycled cycle oil which will be processed with the hydrocarbon products downstream. When the temperature of the hydrocarbon products decrease in the first heat exchanger 52, the cycle oil will wet on the tube wall. This liquid phase will help wash away heavy cyclic coke precursors and avoid coking on the tube walls. This same washing effect may also occur in the subsequent heat exchangers 72 and 86.

EXAMPLE

We determined the steam that could be regenerated from FCC product vapors at a temperature of 513° C. (955° F.) and 229 kPa (33.2 psia) was equivalent to 0.1 kg (0.175 lb) of superheated very high pressure steam per pound of hydrocarbon feed fed to an FCC unit. Hence, 0.52 kW of power may be recovered per pound per hour of feed fed to an FCC unit. This equates up to 20 MW-h of power generated from a 70,000 barrel per day FCC unit.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. A process for recovering heat from a fluid catalytic cracking unit comprising:

contacting cracking catalyst with a hydrocarbon feed stream to crack the hydrocarbons to gaseous product hydrocarbons having lower molecular weight and deposit coke on the catalyst to provide coked catalyst;

separating said coked catalyst from said gaseous product hydrocarbons;

indirectly heat exchanging said gaseous product hydrocarbons with a heat exchange media to provide superheated heat exchange media and provide a hot product hydrocarbon stream;

directing said superheated heat exchange media to an expander;

recovering power from said superheated heat exchange media in said expander;

separating said hot product hydrocarbon stream to obtain a plurality of product streams; and feeding at least a portion of one of said product streams along with said gaseous product hydrocarbons to be indirectly heat exchanged with said heat exchange media.

2. The process of claim 1 wherein the step of indirectly heat exchanging said gaseous product directly follows said separating step.

3. The process of claim 1 wherein said product stream is a cycle oil stream.

4. The process of claim 1 further comprising: adding oxygen to said coked catalyst; combusting coke on said coked catalyst with oxygen to regenerate said catalyst and provide flue gas; and separating said catalyst from said flue gas.

5. The process of claim 1 wherein said heat exchange media is steam.

6. A process for recovering heat from a fluid catalytic cracking unit comprising:

contacting cracking catalyst with a hydrocarbon feed stream to crack the hydrocarbons to gaseous product hydrocarbons having lower molecular weight and deposit coke on the catalyst to provide coked catalyst;

separating said coked catalyst from said gaseous product hydrocarbons;

indirectly heat exchanging said gaseous product hydrocarbons with a heat exchange media to provide superheated heat exchange media and provide a hot product hydrocarbon stream;

directing said superheated heat exchange media to an expander;

recovering power from said superheated heat exchange media in said expander;

separating said warm product hydrocarbon stream to obtain a plurality of product streams;

feeding at least a portion of one of said product streams along with said gaseous product hydrocarbons to be indirectly heat exchanged in a heat exchanger with said heat exchange media; and wetting the walls of said heat exchanger.

7. The process of claim 6 wherein said product stream is a cycle oil stream.

8. The process of claim 6 wherein said heat exchange media is steam.

9. A process for recovering heat from a fluid catalytic cracking unit comprising:

contacting cracking catalyst with a hydrocarbon feed stream to crack the hydrocarbons to gaseous product hydrocarbons having lower molecular weight and deposit coke on the catalyst to provide coked catalyst;

separating said coked catalyst from said gaseous product hydrocarbons;

indirectly heat exchanging said gaseous product hydrocarbons with a heat exchange media to provide superheated heat exchange media and provide a hot product hydrocarbon stream;

directing said superheated heat exchange media to an expander;

recovering power from said superheated heat exchange media in said expander;

adding oxygen to said coked catalyst;

combusting coke on said coked catalyst with oxygen to regenerate said catalyst and provide flue gas;

separating said catalyst from said flue gas;

separating said hot product hydrocarbon stream to obtain a plurality of product streams; and feeding at least a portion of one of said product streams along with said gaseous product hydrocarbons to be indirectly heat exchanged with said heat exchange media.

* * * * *